US007537117B2

(12) United States Patent
Roesler

(10) Patent No.: US 7,537,117 B2
(45) Date of Patent: May 26, 2009

(54) CASE WITH SLIDE CLOSURE

(76) Inventor: Peter Roesler, Ifenweg 3, D-88239 Wangen/Allgäu (DE)

( * ) Notice: Subject to any disclaimer, the term of this patent is extended or adjusted under 35 U.S.C. 154(b) by 508 days.

(21) Appl. No.: 11/340,304

(22) Filed: Jan. 26, 2006

(65) Prior Publication Data

US 2006/0169695 A1 Aug. 3, 2006

(30) Foreign Application Priority Data

Jan. 28, 2005 (DE) ..... 20 2005 001 458 U

(51) Int. Cl.
*B65D 85/28* (2006.01)

(52) U.S. Cl. ..... 206/379; 206/1.5; 206/443; 70/63; 292/139

(58) Field of Classification Search ..... 206/1.5, 206/376, 377, 378, 379, 443, 807; 220/214, 220/315, 324, 835; 383/5, 64; 70/50, 129, 70/439, 440; 292/137, 283, 146, 150, DIG. 38; 24/615, 625, 585.1, 585.12, 573.09
See application file for complete search history.

(56) References Cited

U.S. PATENT DOCUMENTS

| | | | | |
|---|---|---|---|---|
| 4,934,162 | A * | 6/1990 | Rasch | 70/69 |
| 4,974,740 | A * | 12/1990 | Niles et al. | 220/324 |
| 6,286,999 | B1 * | 9/2001 | Cappel et al. | 383/5 |
| 6,547,077 | B1 * | 4/2003 | Budert | 206/754 |
| 6,755,302 | B1 * | 6/2004 | Streich et al. | 206/373 |

FOREIGN PATENT DOCUMENTS

EP 0 658 486 A1 6/1995

* cited by examiner

*Primary Examiner*—Luan K Bui
*Assistant Examiner*—Dene Quest
(74) *Attorney, Agent, or Firm*—Frederick L. Tolhurst, Esq.; Cohen & Grigsby, P.C.

(57) ABSTRACT

A case for holding elongate objects, in particular, a case for holding drills or other elongate tools, comprising a housing shell with a lid hinged pivotably to the rear part thereof via a horizontal pivoting axis, wherein a closure device is disposed on the pivotable frontal part of the lid between the lid and the housing shell, wherein the closure device comprises a slide closure with at least one removable safety nub disposed in its slide path.

6 Claims, 3 Drawing Sheets

CASE WITH SLIDE CLOSURE

CROSS REFERENCE

This application claims priority to German Patent Application No. 20 2005 001 458.3 filed Jan. 28, 2005.

BACKGROUND OF THE INVENTION

1. Field of the Invention

The subject of the invention is a case with a slide closure, in particular, a case for holding drills or other elongate tools.

Insofar as the present description of the invention mentions a "drill case", this is not to be understood as a restriction. The invention relates to a slide closure for all cases suitable for holding elongate objects and having one or a plurality of holding parts for this type of elongate objects, wherein upon opening of the lid the case is automatically pivoted upwards to offer the objects for removal.

When the later description of the exemplary embodiments calls the elongate objects "drills", this is not to be understood as a restriction. The invention thus relates to all elongate objects suitable to be kept in a case of this type.

2. Description of the Prior Art

A problem with the cases of the prior art lies in the fact that cases of this type are also sold filled with tools and similar items. If a ready-filled case is displayed on the wall of a display room, the risk is incurred that the case may be opened and the content may be completely or partially removed without authorization. A later purchaser of the case generally will not check the content of the case and will find out later that the content is missing or incomplete.

For this reason, the practice is known to the art of attaching a warranty sticker on the closure between the lid and the housing shell of so-called tin cases, in order to control unauthorized opening of the case. Warranty stickers of this type, however, are not reliable, since they are easy to imitate, and the attachment of a warranty sticker increases the cost of the manufacture of this kind of a case.

Based on the subject of the patent application EP 0 658 486 A1, a safety device against unauthorized opening of a case has become known to the art. The said safety device comprises a block manufactured of synthetic materials and pivotably attached to a film hinge which block can be pivoted into the pivoting path of the catch for the closure between lid and housing shell.

When in the safety position, the safety block thus comes to rest against the rear side of the latch and prevents the opening thereof.

If opening is to be permitted, the plastic block has to be detached from the film hinge, whereafter it is released and no longer blocks the opening path of the latch.

However, the attachment of this kind of a plastic block connected to the lid via a film hinge entails increased manufacturing cost.

Furthermore, the removal of the said safety device is only associated with higher cost and complication, because the plastic block is hidden underneath the edge of an opening in a way to be practically unreachable and the film hinge to be removed can only be destroyed with costly tools.

The invention therefore relates to the object of refining a safety device of a case with lid and housing shell of the type described above in such a way that it is simpler to manufacture as well as safer and simpler to operate.

The stated object is achieved according to the invention as characterized by the enabling disclosure.

Advantageous refinements of the subject of the invention are the subject of the subclaims.

From the given enabling disclosure, the substantial advantage arises that a safety nub is disposed within the slide path of a slide closure by being sprayed immediately onto the material of the housing shell.

The manufacture of the said safety nub therefore is particularly simple and cost-effective because the manufacture of costly film hinges is not needed.

Due to the arrangement of the said safety nub in the slide path of the slide closure, a further advantage arises in the fact that the safety nub is well detectable from the outside so that the said safety nub has the effect of a warranty closure.

This was not the case in the prior art. It was not possible to detect from the outside whether the warranty closure (in the form of the plastic block) was still engaged with the closure lever or whether it had already been removed.

A further advantage of the measure according to the invention lies in the fact that the safety nub now can preferably only be removed with a tool. Manual removal is practically not possible, because the single-material injection molded bonding between the safety nub and the material of the housing shell provides a connection of such firmness that it cannot be dissolved with the bare hand.

Of course, the present invention is not limited to the arrangement of the safety nub on the housing shell. The kinematic reversal is also claimed wherein the safety nub is disposed on the slide closure and acts against a stop disposed in the slide path of the slide closure on the housing shell.

Here again, the safety nub has to first be removed from the slide closure with a tool, in order to move the slide closure into its open position.

SUMMARY OF THE INVENTION

The subject of the present invention ensues not only from the subject of the individual patent claims, but also from the combination of the individual patent claims with one another.

All data and features disclosed in the documentation, including the abstract, in particular, the spatial structure represented in the drawings, are claimed as substantial for the invention insofar as they are novel individually or in combination as compared to the prior art.

BRIEF DESCRIPTION OF THE DRAWINGS

The invention is explained in detail herebelow with reference to drawings representing only one way of carrying out the invention. In this context, additional substantial features and advantages of the invention become evident from the drawings and their descriptions.

DESCRIPTION OF A PRESENTLY PREFERRED EMBODIMENT OF THE INVENTION

Figure 1:
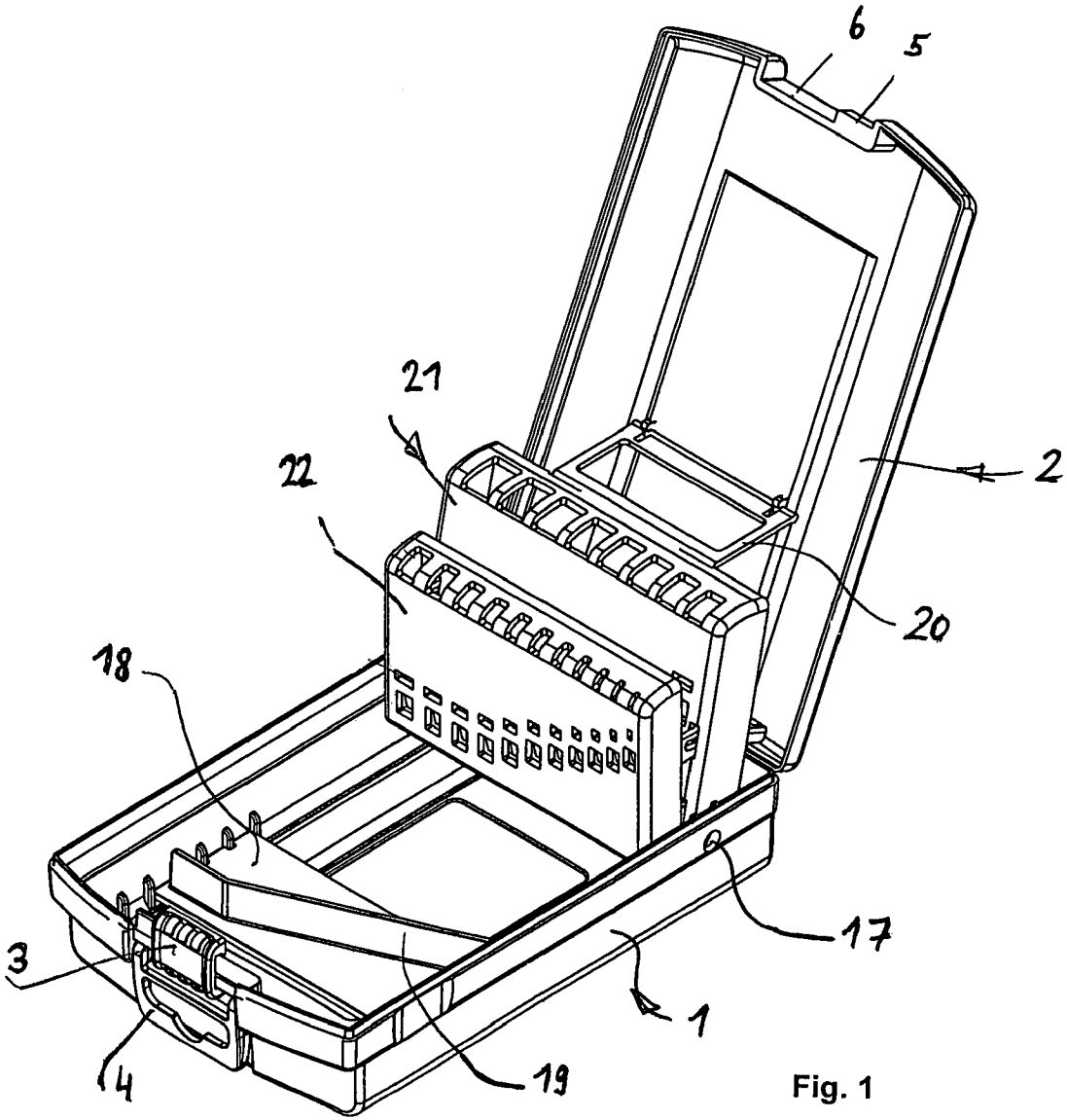
FIG. 1: shows a schematic front view of a case with slide closure.

The case according to FIG. 1 is manufactured—as detailed above—of all-plastics material, an ABS material being preferably used as material for the housing shell 1 and the lid 2, while a propylene is used for the holding parts 16, 17.

The use of all-plastics material for all components leads to the additional important aspect that this kind of a completely filled drill case may drop from a height of two meters onto hard ground without incurring damage to the housing, the content, or the holding parts 16, 17.

Due to the use of a special slide closure 3 between the lid and the housing shell, coincidentally, an unintended opening of the lid 2 is prevented in this extreme example, as well.

The lid 2 is hinged pivotably to the rear side of the housing shell 1 with the aid of two hinges disposed in parallel In FIG. 1, the lid 2 is pivotably connected to the rear end wall of the housing shell 1 via a horizontal pivoting axis preferably designed as film hinge.

One or a plurality of holding parts 21, 22 for holding any elongate objects, though in particular, drills, are provided in the interior of the housing shell 1.

The holding part 21 closest to the lid is pivotably connected to the lateral wall of the housing shell 1 in the area of a pivoting axis 17.

The upper, pivotable part of the holding part 21 is pivotably connected to the lid 2 via a bracket 20.

When the lid 2 is opened, therefore, the two holding parts 21 and 22 lift up from the interior of the housing shell 1 and arrange themselves in the position shown in FIG. 1.

Herein, the frontal holding part 22 is pivotably attached to the holding part 21 disposed close to the lid.

The objects stored in the individual compartments of the holding parts 21, 22 thus can be brought into a convenient position for removal.

In order to limit the displacement of the objects kept in the compartments of the holding parts 21, 22, an adjustable length stop 18 is provided to be disposed adjustably in the interior of the housing shell 1 and to be equipped with a stop rib 19 against which the ends of the tools kept in the compartments come to a stop.

The closure device between the housing shell 1 and the lid 2 comprises a slide closure 3 disposed in the frontal part of the housing shell 1. Furthermore, in order to be able to hang the case on a wall or similar, a pivotable hanging device 4 is provided on the frontal face.

The closure device functions due to the fact that a release 6 and an adjacent retaining strip 5 are constructed into the corresponding side of the lid 2.

Figure 2:
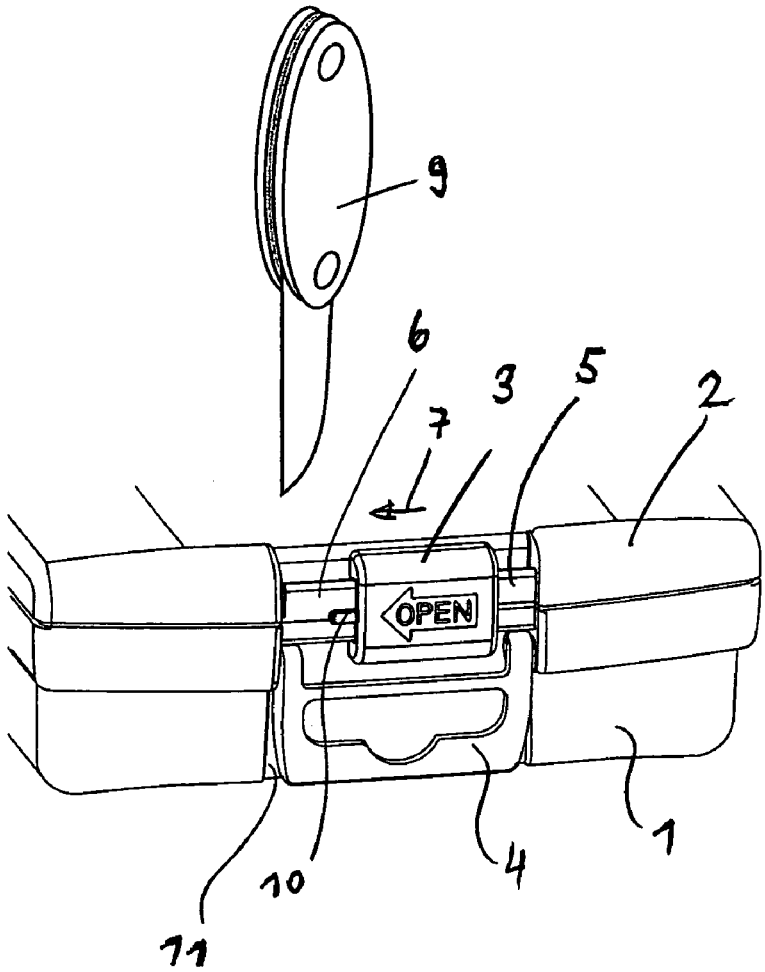
FIG. 2: shows an enlarged frontal view of the case according to FIG. 1 with closed lid and with the slide closure in closed position.

When in closed position, the c-shaped slide closure (see also FIG. 6) according to FIG. 2 encloses the holding strip 5 on the lid so that an absolutely secure closure exists between lid and housing shell 1, which permits the case to withstand a drop from even great heights without damage, and the said closure cannot be switched into open position.

Now, a safety nub 10 preventing a displacement of the slide closure 3 in the direction of the arrow 7 is applied by being sprayed on in single-material with the housing shell and disposed in the slide path 7 of the slide closure 3.

Figure 3:
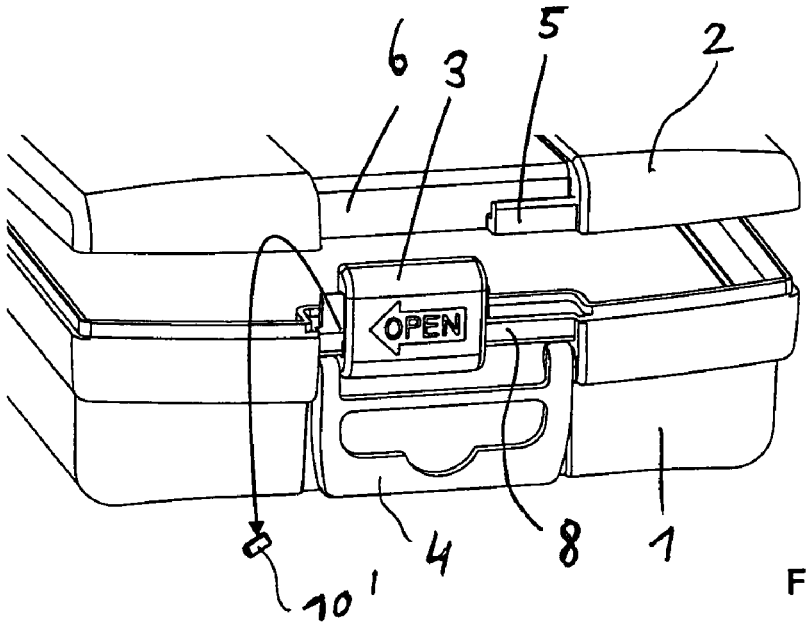
FIG. 3: shows the arrangement according to FIG. 2 with the slide closure in open position.
Figure 4:
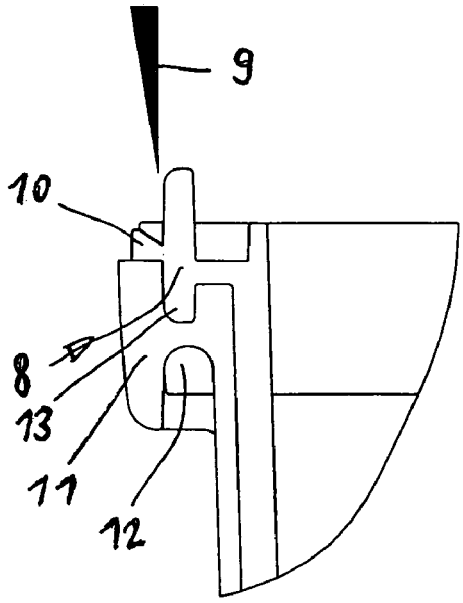
FIG. 4: shows a schematic representation of the removal of the safety nub.
Figure 5:
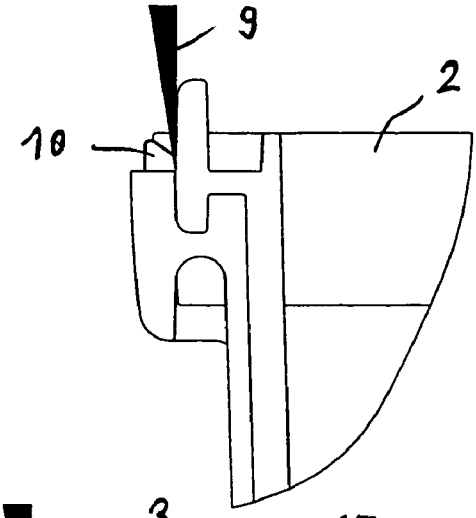
FIG. 5: shows the representation of FIG. 4 briefly before the removal of the safety nub.
Figure 6:
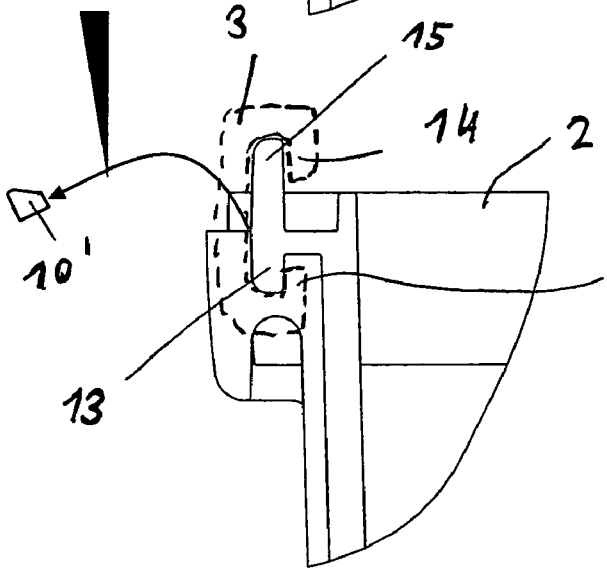
FIG. 6: shows the representation of FIG. 5 with removed safety nub.

In order to open the lid 2 for the first time, therefore, the safety nub 10 has to be removed with a suitable tool, as shown in FIG. 3 and in FIGS. 4 through 6.

The safety nub 10 here is applied by being sprayed onto the frontal wall of the housing shell 1 in the area of an approximately double-T-shaped guide rail 8, and the c-shaped slide encloses the guide rail 8 so that it is held on the said guide rail 8 in such a way that the said slide can be displaced but not removed.

Using a sharp tool 9 (e.g. a knife), the blade of the said tool has to be inserted from above against the safety nub 10 according to FIG. 4, in order to detach the safety nub from the guide rail 8 according to FIG. 5.

Not until the safety nub has been removed from the guide rail 8 in position 10', can the slide closure 3 be displaced into its open position according to FIG. 3. The slide closure thus is released from the retaining strip 5 in the lid and the lid 2 now can be easily pivoted away from the housing shell 1.

Preferably, the entire closure device is disposed in a housing indentation 11 receding from the end wall of the housing wall 1 in order to prevent an unintended operation of the slide closure 3. The slide closure 3 thus is disposed in at least flush-mounted construction in the housing indentation 11.

FIG. 4 also shows a bore 12 into which one of the axis stubs engages on one side of the hanging device.

An identical bore 12 is disposed on the opposite side of the housing indentation 11.

FIG. 6 shows the structure of the double-T guide rail 8 with an upper branch 15 and a lower branch 13.

The c-shaped slide closure 3 encloses the two branches 13, 15 by means of the lugs 14, 16.

The said slide closure 3 is therefore held on the guide rail 8 without the possibility of being detached or lost.

One advantage of the disposition of the safety nub 10 on the frontal side of the guide rail 8, therefore, lies in the fact that in the closed position of the closure device, the guide nub 2 is clearly visible and, for example, a cashier in a home-improvement store can detect without difficulty whether the case was already opened before its sale.

LEGEND FOR DRAWINGS

1 housing shell
2 lid
3 slide closure
4 hanging device
5 retaining strip (lid)
6 release (lid)
7 slide path
8 guide rail
9 tool
10 safety nub 10'
11 housing indentation
12 bore
13 branch
14 lug
15 branch
16 lug
17 pivoting axis
18 length stop
19 stop rib
20 bracket
21 holding part
22 holding part

What is claimed is:

1. A case for holding elongate objects, said case comprising:

a housing shell;

a lid that is pivotably hinged to the rear part of said housing shell by a horizontal pivoting axis;

a rail that is connected to one of said pivotable lid or said housing shell;

a slide closure that has a c-shaped cross section and that engages the rail such that the slide closure is held on said rail and is displaceable along the rail to define a slide path along said rail;

a retaining strip that is connected to the other of said pivotable lid or said housing shell from said rail, said retaining strip being oriented with said rail such that said retaining strip is in the slide path defined by said slide closure when said slide closure is in a first position along said rail where said slide closure engages both of said rail and said retaining strip, said slide closure locking said lid and said housing shell together at times when said slide closure is in said first position, said slide closure also engaging said rail but not said retaining strip at times when said slide closure is displaced away from said first position such that said lid and said housing shell are not locked together; and a removable safety nub that is bonded to both said rail and to said slide closure with said slide closure in said first position, said safety nub being located in the slide path of the slide closure to secure the slide closure in said first position.

2. A case according to claim 1 wherein the safety nub is removeable with the aid of a cutting tool, said safety nub blocking movement of said slide closure away from said first position unless said safety nub is removed from said rail.

3. A case according to claim 2 wherein the safety nub is a plastic part that is comprised of the same material as the slide closure.

4. A case according to claims 2 wherein the safety nub is a plastic part that is comprised of the same material as the housing shell.

5. A case according to one of claims 1, 2, 3 or 4 wherein the slide closure is a plastic part that is disposed on the front part of the pivotable lid between the lid and the housing shell, and wherein said rail is a double-T-shaped profiled guide rail that is connected to the housing shell.

6. A case according to claim 1 wherein said safety nub is bonded to said slide closure and to said rail by spraying said safety nub onto said slide closure and said rail.

* * * * *